US010322852B2

(12) United States Patent
Hagleitner

(10) Patent No.: US 10,322,852 B2
(45) Date of Patent: Jun. 18, 2019

(54) CONTAINER AND DISPENSING SYSTEM HAVING THE CONTAINER

(71) Applicant: Hans Georg Hagleitner, Zell Am See (AT)

(72) Inventor: Hans Georg Hagleitner, Zell Am See (AT)

( * ) Notice: Subject to any disclaimer, the term of this patent is extended or adjusted under 35 U.S.C. 154(b) by 211 days.

(21) Appl. No.: 15/186,721

(22) Filed: Jun. 20, 2016

(65) Prior Publication Data

US 2016/0297573 A1 Oct. 13, 2016

Related U.S. Application Data

(63) Continuation of application No. PCT/AT2014/000223, filed on Dec. 15, 2014.

(30) Foreign Application Priority Data

Dec. 20, 2013 (AT) ..... 976/2013

(51) Int. Cl.
*B65D 41/02* (2006.01)
*B65D 75/58* (2006.01)

(52) U.S. Cl.
CPC ..... *B65D 41/026* (2013.01); *B65D 41/023* (2013.01); *B65D 75/5877* (2013.01)

(58) Field of Classification Search
CPC . B65D 41/026; B65D 41/023; B65D 75/5877
USPC ..... 222/92, 93, 105, 107, 181.2, 215
See application file for complete search history.

(56) References Cited

U.S. PATENT DOCUMENTS

| | | | |
|---|---|---|---|
| 2,472,582 | A | 6/1949 | Green |
| 4,570,827 | A | 2/1986 | Roggenburg, Jr. et al. |
| 5,730,694 | A | 3/1998 | Hagleitner |
| 6,212,721 | B1 | 4/2001 | Borodulin et al. |
| 6,314,262 | B1 | 11/2001 | Kunihiro et al. |
| 6,758,372 | B2 | 7/2004 | Studer et al. |
| 8,261,945 | B2 | 9/2012 | Haworth |
| 2004/0232168 | A1 | 11/2004 | Ciavarella et al. |
| 2007/0108207 | A1 | 5/2007 | Malek |
| 2009/0026225 | A1 | 1/2009 | Lickstein |
| 2009/0272752 | A1 | 11/2009 | Hagleitner |

FOREIGN PATENT DOCUMENTS

| | | | |
|---|---|---|---|
| CH | 264561 | A | 3/1950 |
| EP | 1118301 | A1 | 7/2001 |
| EP | 1719441 | A1 | 11/2006 |
| GB | 984593 | A | 2/1965 |
| WO | 9509111 | A1 | 4/1995 |
| WO | 2008089500 | A2 | 7/2008 |
| WO | 2009013173 | A2 | 1/2009 |

*Primary Examiner* — Vishal Pancholi
(74) *Attorney, Agent, or Firm* — Laurence A. Greenberg; Werner H. Stemer; Ralph E. Locher

(57) ABSTRACT

A container includes a connection with an opening and a removable closure. At least one guide element, on or in which the closure is displaceable, is provided on the connection. At least one socket projecting forwardly in a sliding direction is formed on a side of the container having the connection. A dispensing system having the container is also provided.

16 Claims, 17 Drawing Sheets

CONTAINER AND DISPENSING SYSTEM HAVING THE CONTAINER

CROSS-REFERENCE TO RELATED APPLICATION

This is a continuation application, under 35 U.S.C. § 120, of copending International Application PCT/AT2014/000223, filed Dec. 15, 2014, which designated the United States; this application also claims the priority, under 35 U.S.C. § 119, of Austrian Patent Application A 976/2013, filed Dec. 20, 2013; the prior applications are herewith incorporated by reference in their entirety.

BACKGROUND OF THE INVENTION

Field of the Invention

The invention relates to a container including a connection having an opening, a closure removable by displacement of the container in a slide direction, and at least one guide element which is provided on the connection and at or in which the closure is slidable relative to the container. The invention also relates to a dispensing system for a flowable product, including at least one dispenser provided with a container mounting and at least one container containing the flowable product.

A container and a dispensing system of that kind are described for example in International Publication WO 95/09111, corresponding to U.S. Pat. No. 5,730,694 or International Publication WO 2008/089500, corresponding to U.S. Pat. No. 8,561,844. The dispenser serves for dispensing liquid or creamy products, in particular in the sanitary and hygiene area such as for example soaps, disinfectants, creams and so forth.

A container can be fitted into a dispenser if the region of the container, that surrounds the opening, is compatible with the container mounting of the dispenser. That is thus a prerequisite for being able to use the container at all, but it has the disadvantage that all containers of the same configuration or at least all containers with regions of the same configuration around the opening can be used without a container having the wrong contents being noticeable. That matching relationship is also referred to as coding, in which respect various degrees of coding can be established, which involve the number of the cooperating coding elements.

The container described in the state of the art has a container neck or connection, from which a respective limb of a sliding guide projects at both sides parallel to the end face, and on to which a clip-like C-shaped part which engages behind the limbs is pushed as the closure. Therefore the container mounting on the dispenser is of the same configuration as the closure, that is to say the limbs projecting from the connection have the container mounting engaging therebehind. That makes changing the container easier since a new container can be fitted to and inserted into the container mounting without the closure having to be previously removed. That is advantageous in particular since the container is fitted upside down because the content cannot flow out of same or no additional measures are necessary to prevent that. As soon as the closure bears against the container mounting, the container can be slid and the limbs of the connection slide in grooves of the container mounting, in which case finally the closure is released and lies loose in front of the container mounting.

SUMMARY OF THE INVENTION

It is accordingly an object of the invention to provide a container and a dispensing system having the container, which overcome the hereinafore-mentioned disadvantages of the heretofore-known devices of this general type and which have a sliding closure and codings which extend beyond an engagement of sliding guide elements in order to prevent an insertion of incorrect containers, since it is desirable or even necessary to only fill certain dispensers with certain containers.

With the foregoing and other objects in view there is provided, in accordance with the invention, a container having an opening provided on a connection and a closure removable by displacement of the container in a slide direction, wherein provided on the connection is at least one guide element, at or in which the closure is slidable relative to the container, and at the side of the container having the connection, there is provided at least one projection which projects forwardly in the slide direction and/or at least one forwardly open socket.

A recess or projection in a corresponding relationship therewith is provided on the container mounting respectively corresponding to the projection or to the socket at the side of the container that is provided with the connection. Therefore, upon insertion of the container, the projection and recess or the socket and projection engage into each other.

It is only in that way that the openings in the connection of the container and the container mounting of the dispenser come into alignment so that the content can flow out into the dispenser. Without a possibility of mutual engagement it would only be possible for the container to be pushed into the container mounting over a short length, in which respect that can be recognized by virtue of the fact that the container does not begin to empty and the closure is still hanging on the connection since it has also been pushed out only over the above-mentioned excessively short length.

Projections or sockets are possible at any suitable location on the side of the container that is provided with the connection, preferably in that respect it is provided that at least one projection and/or at least one socket are provided on the connection.

If the connection has limbs projecting at both sides as guide elements, a preferred configuration provides that one of the two limbs is shortened, thereby providing the socket.

Depending on the respective size and nature of the socket it may be advantageous for at least one tab which is attached to the connection by way of an intended breaking location to be broken off to form the socket, for example to provide a precise container coding after filling with the medium.

If only one socket is provided on the container then it is not possible for the container to be turned through 180°. That can be important if for example writing on the inserted container is to be readable. If in contrast a specific position of the container in the dispenser mounting is unimportant then two sockets turned through 180° can be provided in the connection. Insertion of the container is simplified thereby.

If the container and the connection are square then the container can also be provided with four projecting limbs or four sockets. It is also possible to conceive of placing the coding elements in various planes parallel to the slide direction of the container, particularly in mutually superposed relationship, thereby substantially increasing the possible coding combinations.

As mentioned the configuration of projections and sockets is not limited to the connection. In a further preferred embodiment therefore there are provided at least one projection and/or at least one socket at least at one upstanding limb of a U-shaped reinforcing plate of the container, that carries the connection and embraces the container at oppositely disposed edges. If the limb of the reinforcing plate extends perpendicularly to the slide direction a socket is preferably in the form of a hole in the limb.

A further preferred embodiment provides that the guide elements, the recess and/or the projection of the container mounting are provided on an exchangeable insert portion which is held in a cover plate of the lower part of the dispenser.

The substantial components of the dispenser therefore remain the same, irrespective of whether the projection and/or the socket in the connection are provided centrally or off-center as the container mounting which fits the container can be selected and fitted into the cover plate. The container mounting is raised in relation to the region of the cover plate in front thereof, by the thickness of the closure, in order to be able to insert the container connection into the container mounting without impediment. The container mounting is additionally preferably provided with a bevel at the front end to correct inaccuracies.

A further preferred configuration provides that a substantially L-shaped path is defined for insertion of the container into the dispenser, the first path portion of that L-shaped path extending perpendicularly to the slide direction and ending in particular in a depression in the cover plate in front of the container mounting. In that case, there are two conceivable options for the first path portion. In a first variant the L-shape extends overall parallel to the plane of the container opening so that the closed container can firstly be fitted laterally to the dispenser and can be displaced in front of the container mounting and is then pushed in the slide direction, in which case the connection slides into the container mounting and the closure remains disposed in front of same. If it is blocked not only in the slide direction of the container but also in opposite relationship thereto on the cover plate then when changing a container the closure is displaced on to the connection again so that the container which is now closed again can be pushed out laterally.

In the second variant the first path portion extends from above downwardly, in particular vertically or inclined rearwardly.

In both cases the location in front of the container mounting represents a form-locking deposit device for the closure, which is aligned with the container mounting.

The cover plate preferably represents an upper cover of a collecting chamber for the product to be dispensed, for example an intermediate chamber, a pump inlet chamber or the like. Therefore at least one projection is preferably of such a configuration that a hole into the collecting chamber is opened by removal of the projection, for example in order to insert a non-correlating container, and the dispenser thereby loses sealing integrity.

In addition an embodiment is conceivable in which, in a socket in the connection of the container, there is provided a barrier to the through-flow of the medium, and that barrier is opened only when a corresponding projection of the container mounting can penetrate sufficiently into that socket.

Other features which are considered as characteristic for the invention are set forth in the appended claims.

Although the invention is illustrated and described herein as embodied in a container and a dispensing system having the container, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 19 is a diagrammatic perspective view of a first embodiment of the dispenser for soap or the like;

FIG. 25 is a diagrammatic perspective view of a second embodiment of the dispenser for soap or the like;

DETAILED DESCRIPTION OF THE INVENTION

Figure 1:
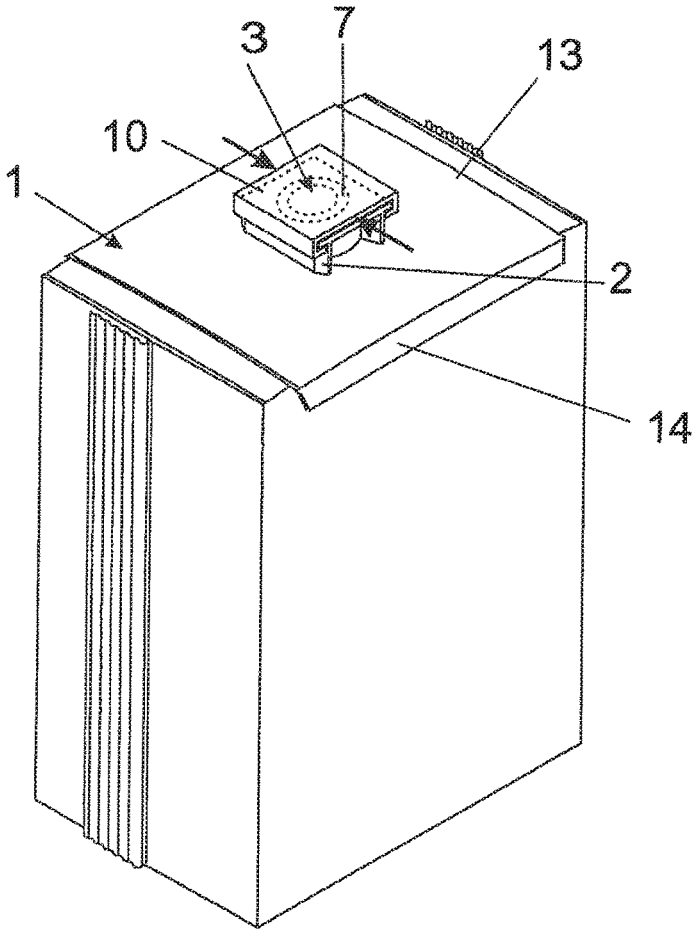
FIG. 1 is a diagrammatic, perspective view of a closed container according to the state of the art.

Referring now to the figures of the drawings in detail and first, particularly, to FIG. 1 thereof, there is seen a container 1 formed of soft flexible material, for example thin plastic film, which is approximately cuboidal and has an opening 3 formed in a wall provided in particular with a reinforcing plate 13, in which the opening 3 is provided within a sealingly closable connection 2 or container neck. As FIG. 1 shows the reinforcing plate 13 extends over a large part of the area of the wall and with side limbs 14 embraces two oppositely disposed edges of the container 1. Details about such a container 1 and its manufacture are to be found in the above-mentioned International Publication WO 2008/089500, corresponding to U.S. Pat. No. 8,561,844.

Figure 19:
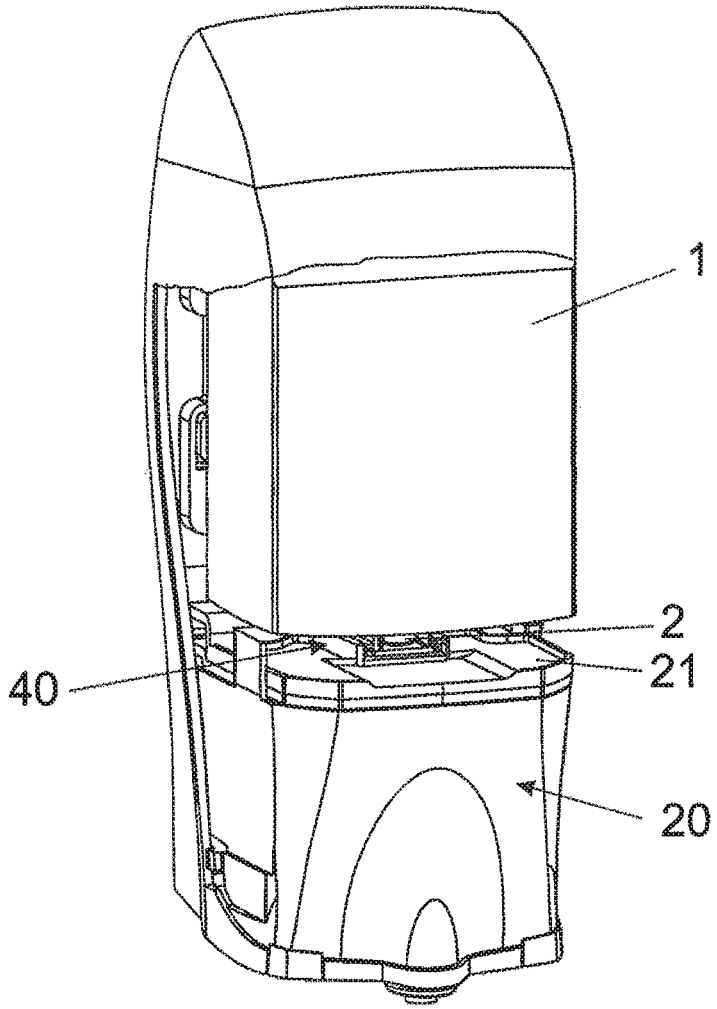
Figure 25:
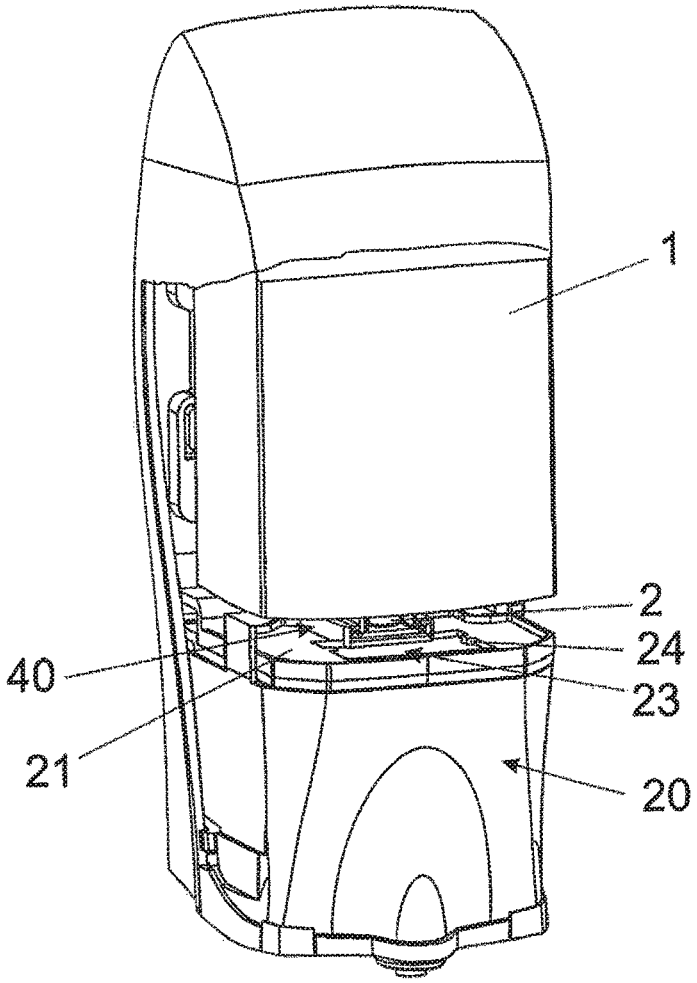
Figure 26:
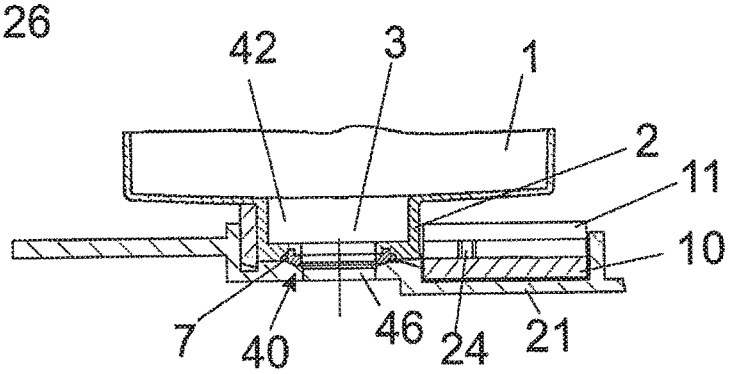
FIG. 26 is a sectional view as shown in FIG. 8 or FIG. 14 through the container mounting with an opened container as shown in FIG. 25.

The container 1 is intended in particular to receive liquid products like disinfectant, shampoo, soap or the like and, as shown in FIG. 19 or 25, is fitted upside down into a dispenser 20 so that the wall provided with the reinforcing plate 13 and the connection 2 forms the support side or the container bottom.

Figure 2:
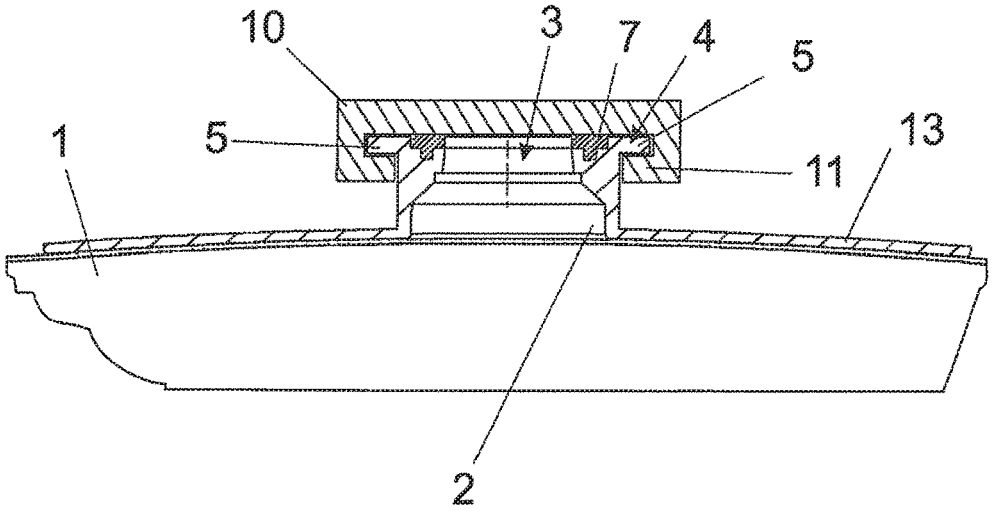
FIG. 2 is a fragmentary, enlarged, vertical-sectional view through the uppermost region of the container of FIG. 1.
Figure 3:
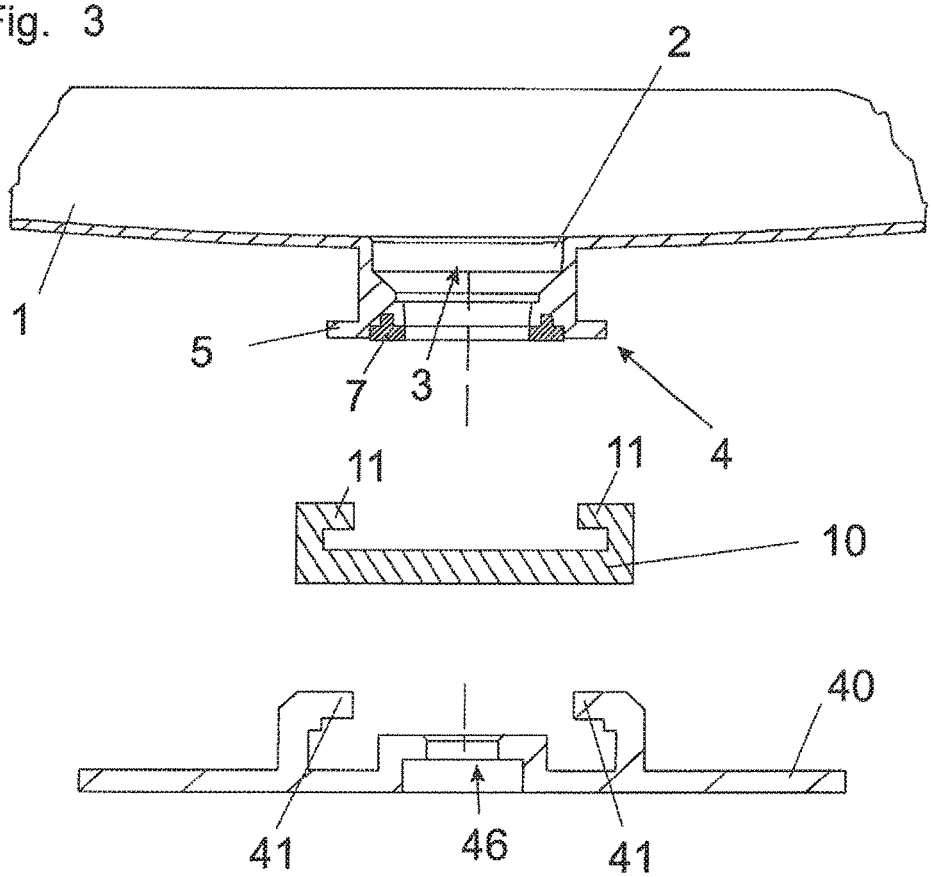
FIGS. 3 and 4 are fragmentary vertical-sectional views of the uppermost region of the upside down container as shown in FIG. 2 in opposite relationship to or in connection with a container mounting of a dispenser.

As shown in detail in FIG. 2 the connection 2 carries a guide element 4 in the form of limbs 5 projecting at both sides as a prolongation of its end face, and a sealing ring 7 projecting slightly from the end face. A closure 10 is in the form of an approximately clip-shaped or C-shaped body which is pushed on from the side, in which case it engages behind the limbs 5 with guide elements 11.

Figure 4:
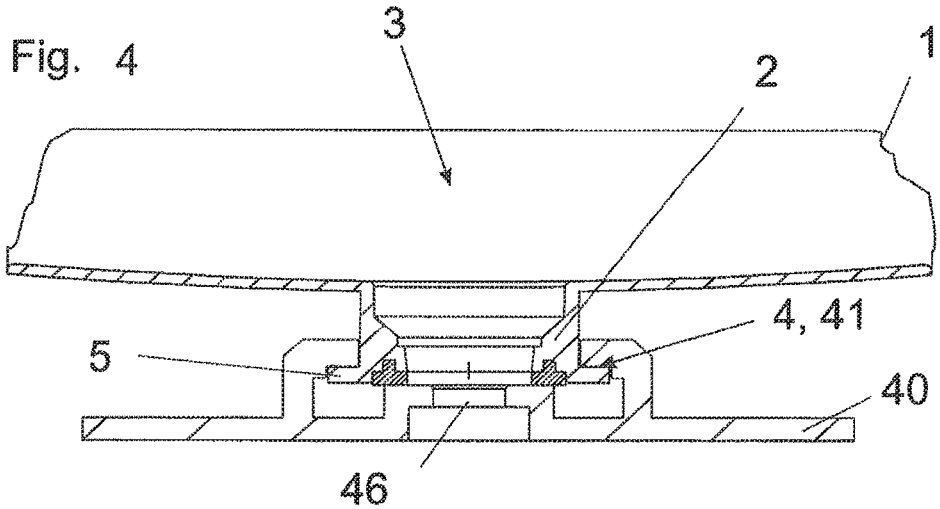
Figure 6:
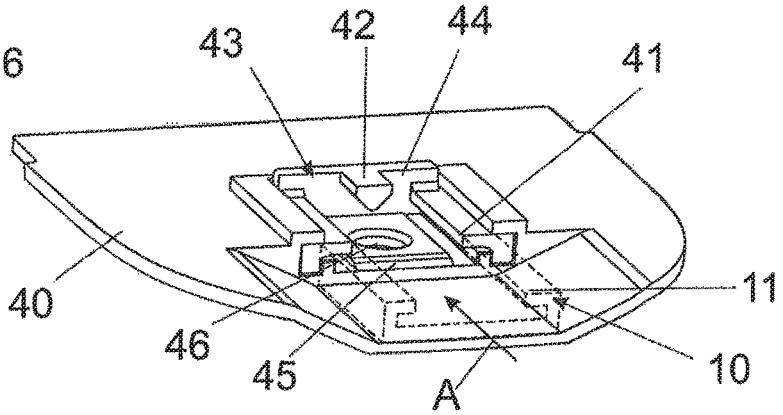
FIG. 6 is a fragmentary perspective view of the container mounting of a dispenser, matching the container of FIG. 5.
Figure 7:
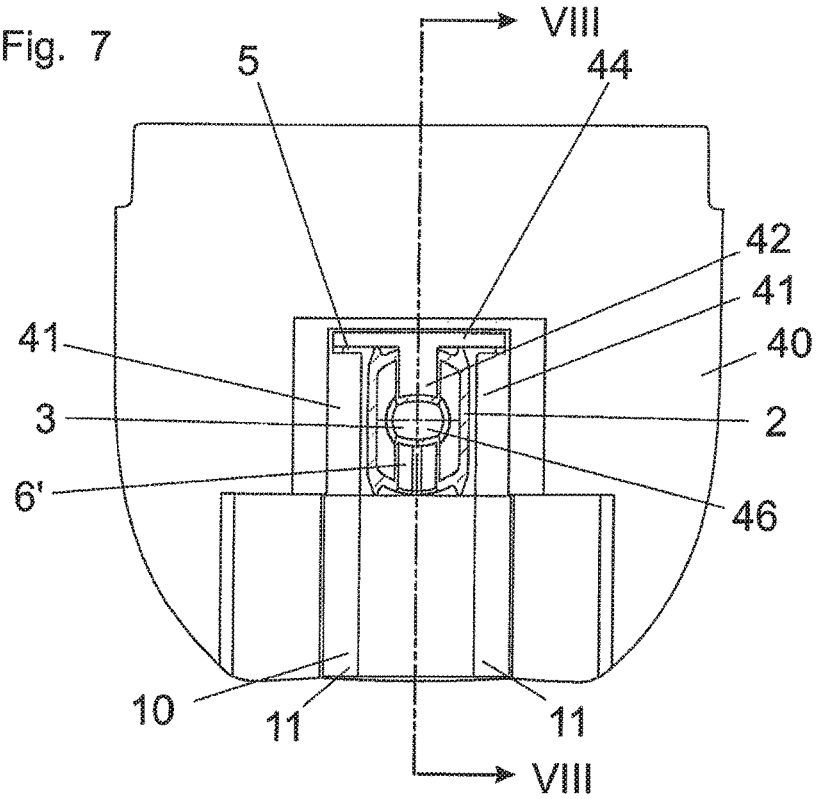
FIG. 7 is a horizontal-sectional view through the container mounting of FIG. 6 with an inserted container.
Figure 8:
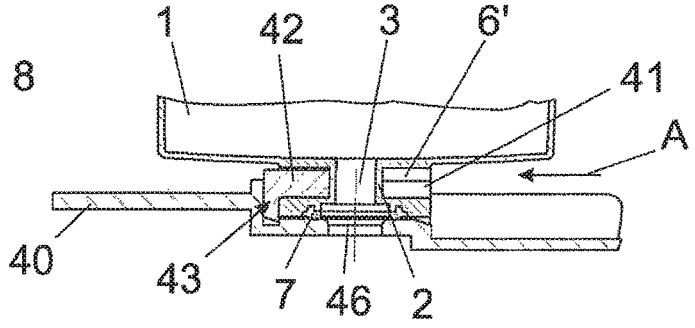
FIG. 8 is a sectional view taken along a line VIII-VIII of FIG. 7, in the direction of the arrows.
Figure 12:
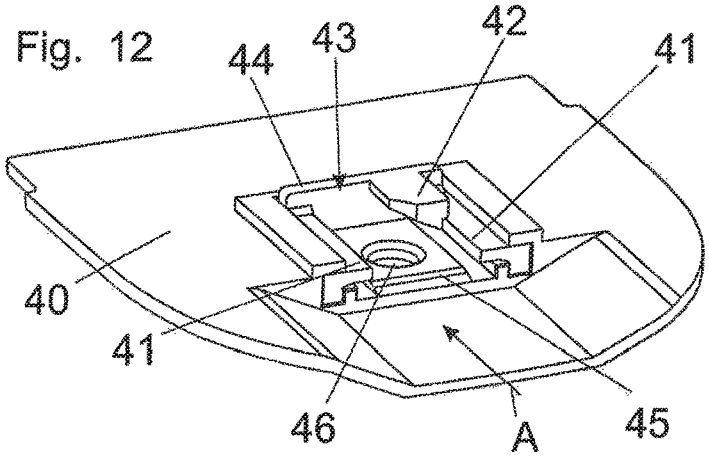
FIG. 12 is a view of the container mounting of a dispenser, matching the container of FIG. 11.
Figure 13:
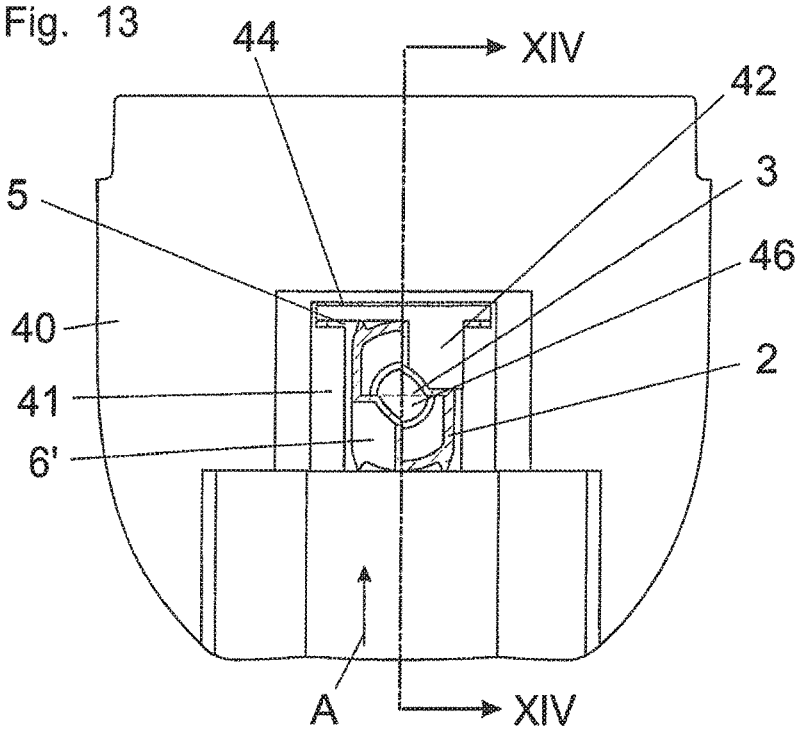
FIG. 13 is a horizontal-sectional view through the container mounting of FIG. 12 with an inserted container.
Figure 14:
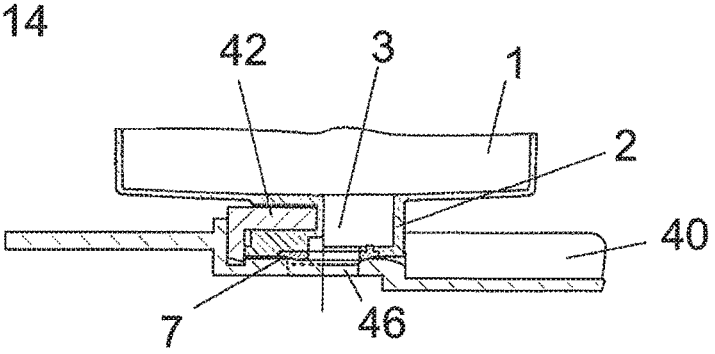
FIG. 14 is a sectional view taken along a line XIV-XIV of FIG. 13 in the direction of the arrows.

The configuration of a sliding guide on the connection 2, that embraces the guide elements 4, 11, simplifies insertion of the container 1 into the dispenser 20, of which further FIGS. 3, 4, 6 through 10 and 12 through 16 respectively only show the single element that is important in that respect, namely the container mounting 40 on the cover plate 21 of the lower portion. The cover plate has an opening 46 which, when the container 1 is inserted and sealed by the sealing ring 7, aligns with the connection 2 and the opening 3 of the container 1 (FIGS. 4, 8, 14). As can be seen from the view in FIG. 3 the container mounting 40 on the cover plate 20 is of the same structure in regard to the guide elements as the closure 10 and can therefore also engage with its guide elements 41 behind the limbs 5 of the connection 2 when the container 1 is inserted into the container mounting 40. That is indicated in FIG. 6 showing the contour of the closure 10 in broken lines. The container 1 is therefore applied with the closure 10 to the container mounting 40 in front of the guide device elements 41 and is then inserted by way of a bevel 45 in the direction of an arrow A, in which case the closure 10 becomes free and remains disposed at the application point, as shown in FIG. 7.

Figure 5:
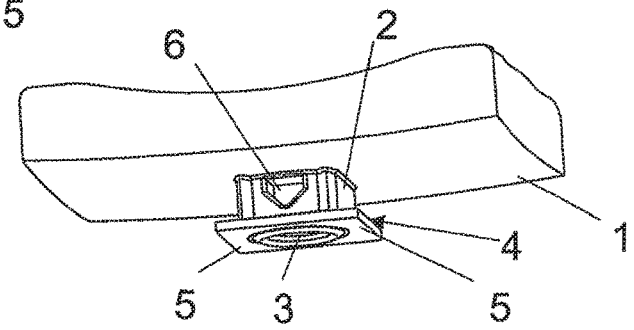
FIG. 5 is a fragmentary perspective view of the uppermost region of a first embodiment according to the invention of a container in the position of use, without a closure.
Figure 9:
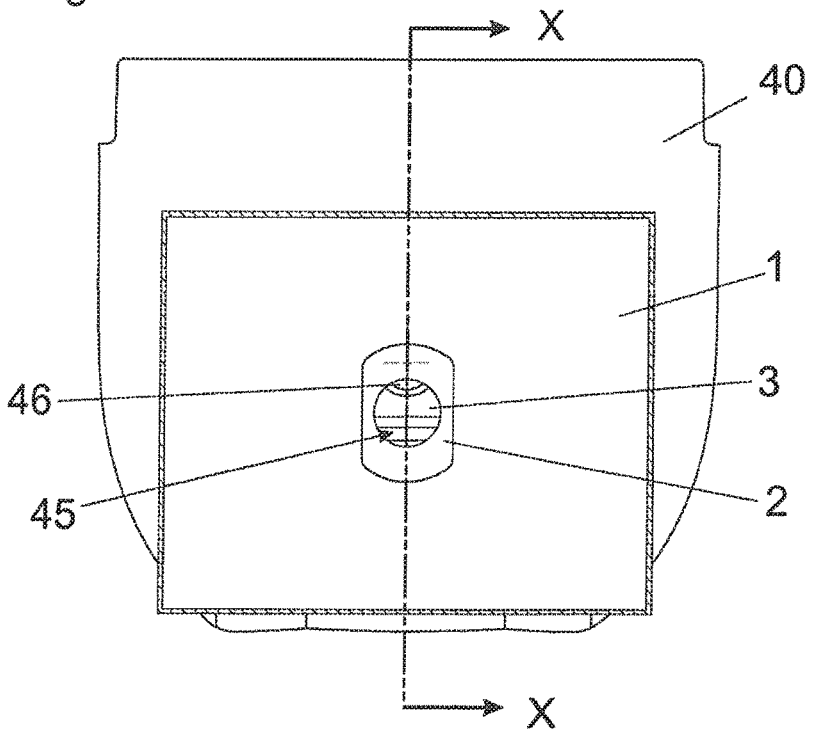
FIGS. 9 and 10 are views corresponding to FIGS. 7 and 8 with a container according to the state of the art without a socket.
Figure 17:
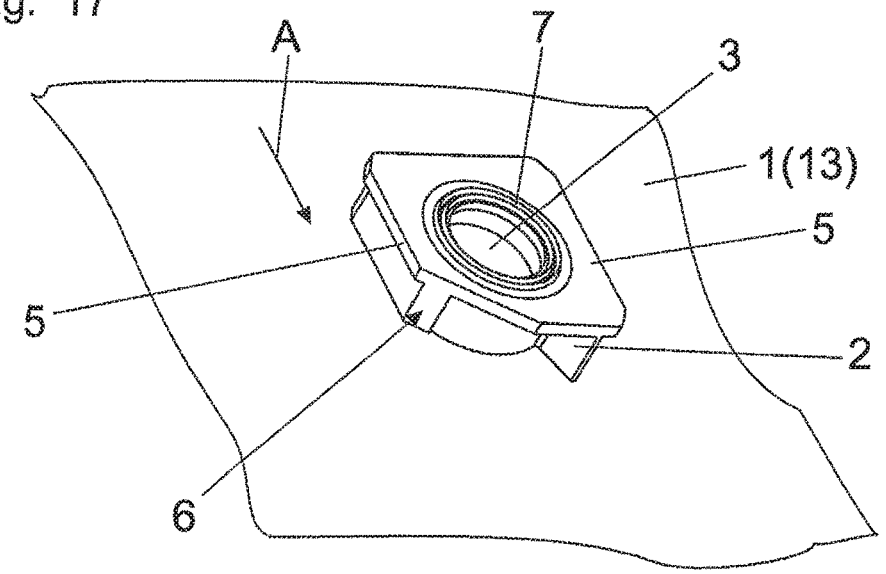
FIGS. 17 and 18 are fragmentary perspective views of the uppermost regions of a third and a fourth embodiment according to the invention of a container, in each case without a closure.

In order now to ensure that only suitable containers or containers with suitable contents can be fitted into the dispenser, there is provided a coding, that is to say the container and the container mounting must be provided with mutually matching elements. In particular therefore at least one projection 42 is provided at the container mounting 40 and at least one corresponding socket 6, 6' (FIGS. 5, 11 and 17) is provided at or in the connection 2 of each corresponding container 1, the projection and the socket respectively extending in the slide direction (arrow A) of the container 1. If the correct container is inserted then, as can be clearly seen from FIGS. 4, 8 and 14, the openings 3 and 46 are aligned. The depth of insertion is limited by the depth of the socket 6 and the length of the projection 42 and by a transverse limb 44 on the container mounting 40. FIG. 5 shows the upper region of a container 1 with a connection 2 in which there is provided a central socket 6 into which the central projection 42 shown in FIG. 6 engages. The cross-sections and lengths of the socket 6 and the projection 42 are the same. The inserted position in which the openings 5 and 46 are aligned can be clearly seen in the section in FIG. 8. The provision of a single central socket 6 is advantageous if only one installation position of the container 1 is wanted. If the aim is that the container 1 can also be inserted turned through 180° then a second central socket 6' is also provided in the connection 2, which is turned through 180° relative to the first, that is to say it is in diametrally opposite relationship, as shown in FIGS. 7 and 9. In cross-section therefore the connection 2 is of an H-shape. Like each socket 6, 6' in this embodiment the projection 42 has a cross-sectional area which is composed of a rectangle with an adjoined triangle. If in spite of two mutually oppositely disposed sockets 6, 6' only one installation position is to be allowed for the container 1 in the dispenser, the closure 10 which is suited thereto can have a projection which fits into the second socket 6' so that the closure 10 can be opened only towards that side.

Figure 11:
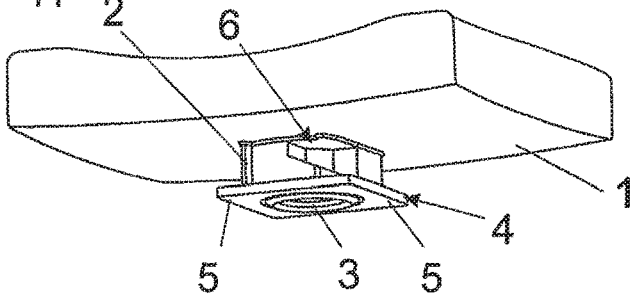
FIG. 11 is a fragmentary perspective view of the uppermost region of a second embodiment according to the invention of a container in the position of use without a closure.

FIG. 11 shows the upper region of a second embodiment of a container 1. In this variant the socket 6 is provided not centrally but laterally, and therefore a corner region of the connection 2 is missing. In this case too, a second socket 6' is preferably turned through 180°, as can be seen from FIG. 13.

FIG. 12 shows the associated container mounting 40 in which the projection 42 is also provided off-center in the corner region. The socket 6 and the projection 42 in this embodiment are of a trapezoidal cross-sectional area. FIG. 13 shows a horizontal section through the connection 2 of the container 1 fitted into the container mounting, in which case by virtue of the socket 6 the connection 2 can be inserted as far as the abutment 44 so that the openings 3, 46 are aligned. That is again visible in the section in FIG. 14.

Figure 10:
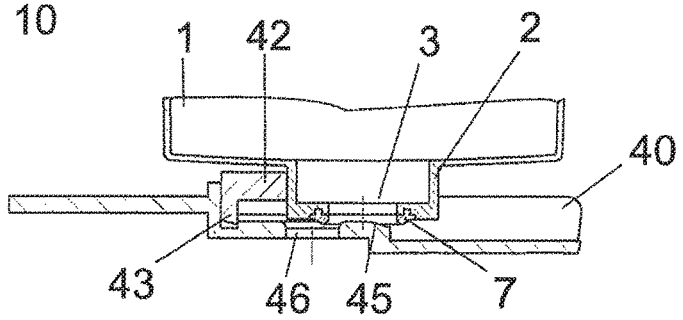
Figure 15:
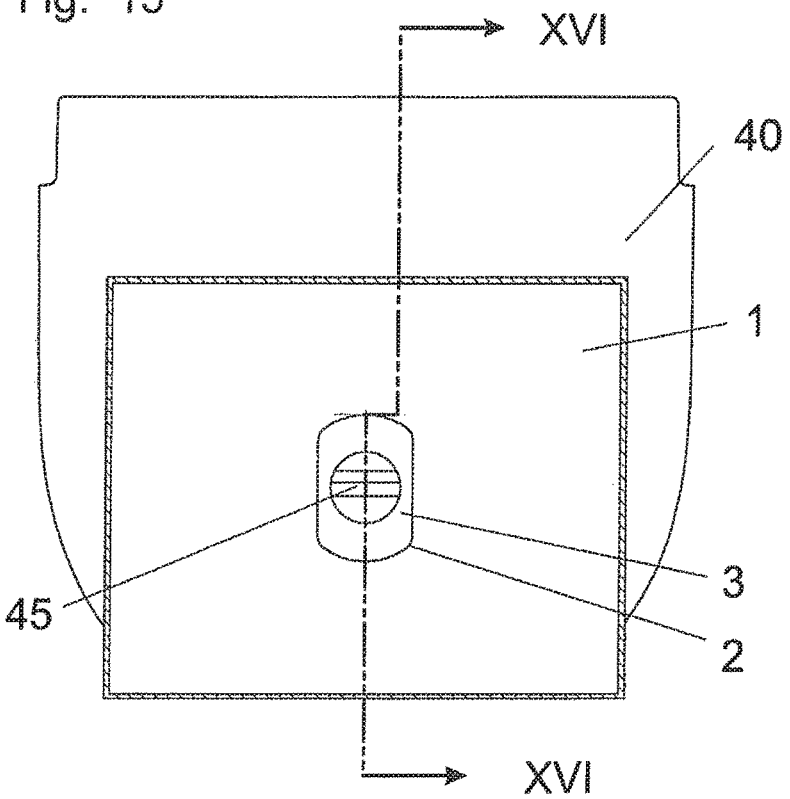
FIGS. 15 and 16 are views corresponding to FIGS. 13 and 14 with a container according to the state of the art without a socket.
Figure 16:
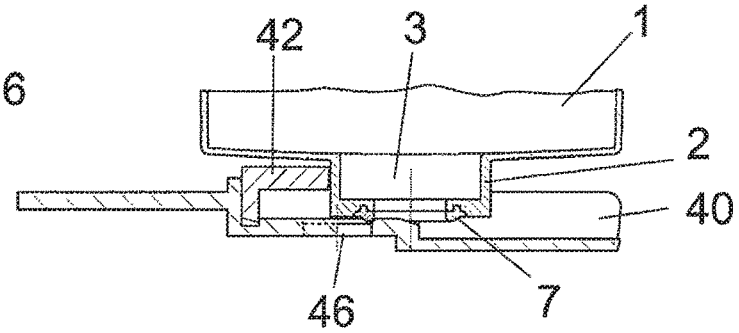

The insertion of an incorrect conventional container corresponding to FIGS. 9 and 15 without a socket is practically out of the question since, as FIGS. 10 and 16 show, it can admittedly be inserted over a short distance, but the openings 3 and 46 are so displaced that no through-flow is achieved.

In the two embodiments shown in FIGS. 5 and 11 the sockets 6, 6' are provided on the connection 2 below the limbs 5 of the sliding guide, which thus extend over the entire depth or length. In the FIG. 17 embodiment the socket 6 extends over the entire height of the connection 2 so that one of the two limbs 5 is shortened. Since more than half of the limb remains, neither the sealed seat of the closure 10 on the connection 2 nor the seat of the connection 2 in the container mounting 40, is adversely affected.

Figure 18:
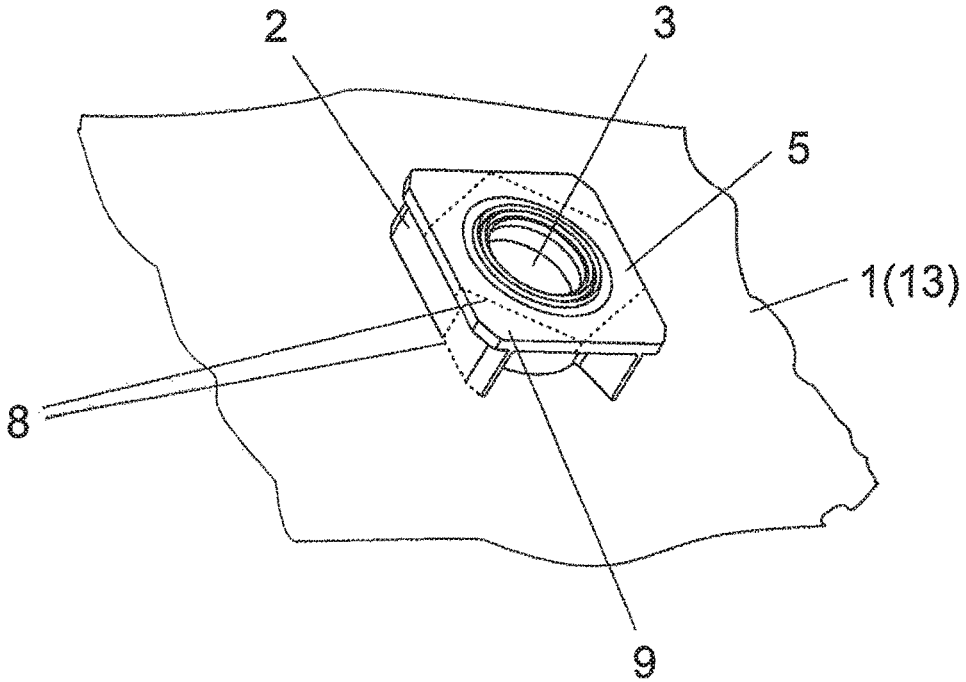

As FIG. 18 shows it is also conceivable for the socket 6 to be produced by breaking off at least one tab 9 which is held to the connection 2 by way of intended breaking lines 8.

In order to only be able to later establish the different coding options upon manufacture of the dispenser, the projection 42, the guide elements 41 and the transverse limb 44 are advantageously provided on an insert portion 43 which can be disposed in matching relationship with the containers to be used with that dispenser, in the cover plate 21 of the lower portion of the container 1.

The above-described embodiments afford protection in particular against the insertion of conventional containers of different manufacturers since the projection in the container mounting device requires recesses and sockets on the container, which as far as possible cannot be subsequently provided.

Reversal of the elements, namely a socket or a recess in the container mounting and a corresponding projection on the connection also represents a coding option in relation to a sliding closure. Such a configuration is desirable in particular when it is only a confusion of products from the same manufacturer, which in particular are not to be mixed up, that is to be excluded, since a conventional container without projection also fits into the container mounting. Such an embodiment is not shown in the figures. Rather, FIGS. 20 through 22 show a hybrid form in which projections and sockets are provided both on the container 1 and also on the container mounting 40.

The container 1 (indicated in FIG. 22) again has a reinforcing plate 13 which with the oppositely disposed limbs 14 embraces two container edges. Each limb 14 has between one and six holes which form sockets 6 belonging to the container 1 and into which between one and six projections 42 can pass upon insertion of the container 1 into the container mounting 40 or its insert portion 43.

In accordance with the rules of combinatorics it is possible to derive therefrom a relatively large number of possible options, each of which is then associated with a given product. FIG. 20 shows for example two such projections 42.

Figure 20:
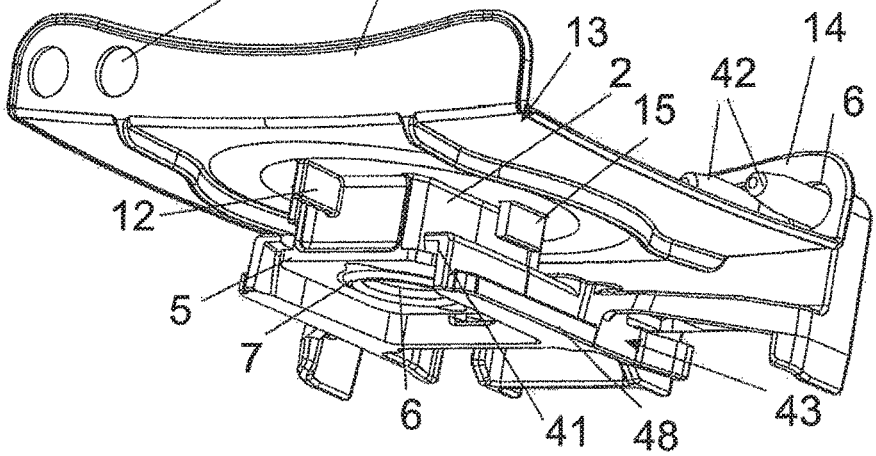
FIG. 20 is a perspective view of the uppermost region of a fifth and a sixth embodiment according to the invention of a container, inserted into an insert portion of the dispenser.
Figure 21:
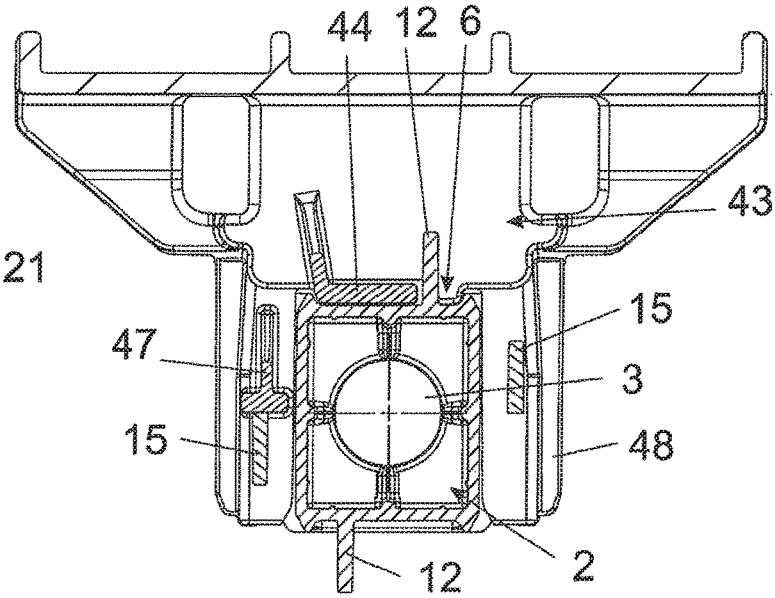
FIG. 21 is a horizontal-sectional view taken along a line XXI-XXI of FIG. 22 in the direction of the arrows.
Figure 22:
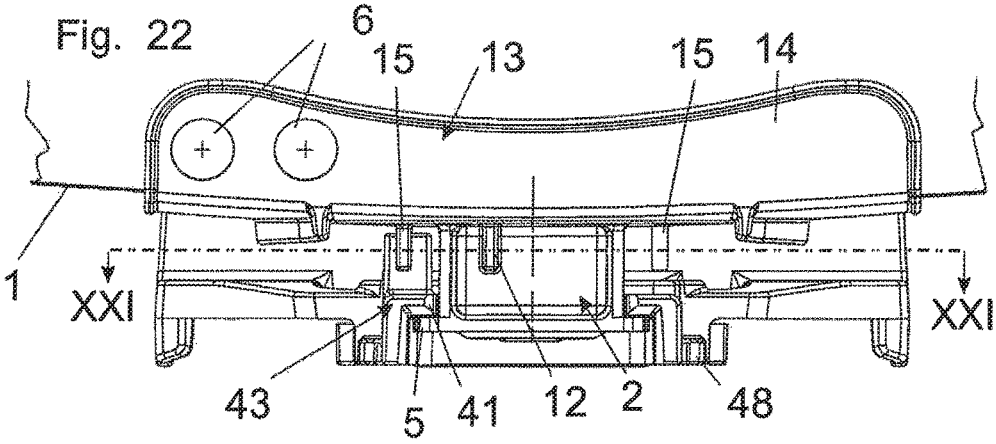
FIG. 22 is a front-elevational view of the elements shown in FIG. 20.

FIGS. 20 through 22 further also show projections 12 in the form of limbs which project from connections 2 in the slide direction (arrow A) and penetrate into a corresponding orientation or socket 6 or a corresponding recess on the container mounting 40 when the container 1 is inserted. In addition disposed on the reinforcing plate 13 are limbs 15 which extend in the slide direction approximately over the second half of the slide travel distance until they come to bear against the projection, which is visible in FIGS. 21 and 22, of the inset portion 43, in the form of an abutment 47. In that end position the connection 2 bears against the transverse limb 44 while the projection 12 has passed into the socket 6 and the opening 3 aligns with the opening 46 (not shown in these figures) in the container mounting 40. The abutment 47 is provided only at the left-hand side in the drawing and the second limb 15 provided at the right-hand side of the connection 2 does not impede insertion since an abutment 47 is missing at that side and a recess is thus also provided there. A container mounting 40 with an insert portion 43 as shown in FIGS. 20 through 22 prevents the insertion of conventional containers only by the projections 42 and the socket 6 in the region of the upstanding limbs 14 since no projections are provided, which require sockets on or in the connection 2. Abutments 47 on the insert portion 43 or on the container mounting 40 itself as well as limbs 12 or 15 on the connection and the reinforcing plate 13 serve primarily to associate given products with given dispensers.

Figure 23:
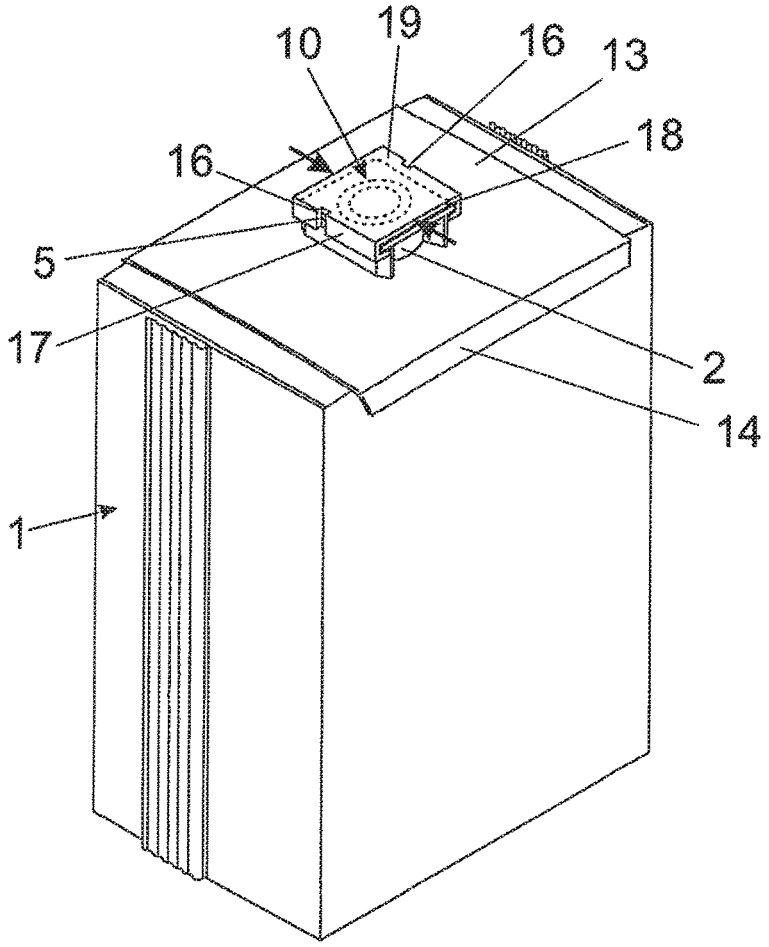
FIG. 23 is a perspective view of a seventh embodiment of a container with a closure.
Figure 24:
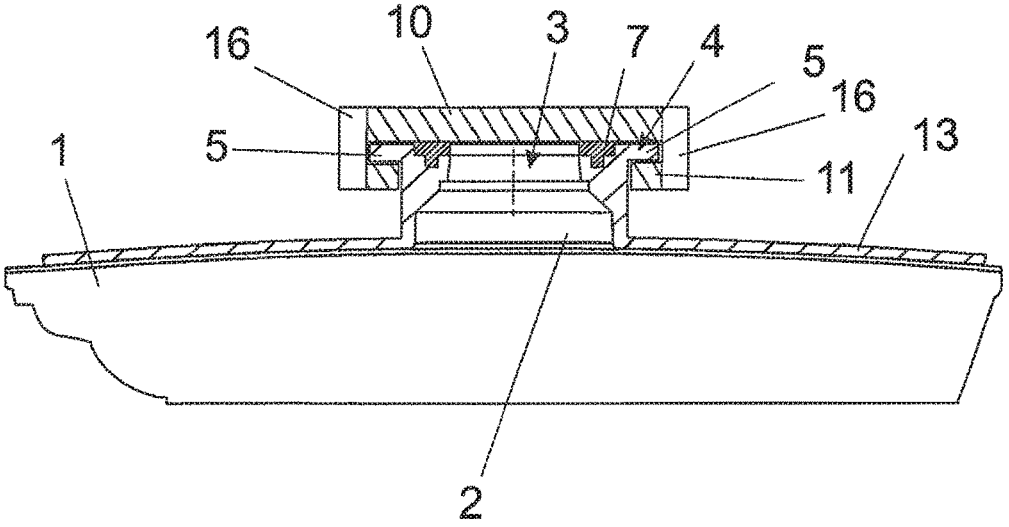
FIG. 24 is a vertical-sectional view through the uppermost region of the container of FIG. 25.

FIG. 23 shows a perspective view of a second embodiment of a container 1, on to the connection 2 of which there is pushed a closure 10 provided with a coding. The closure 10 shown in a number of configurations in FIGS. 23 through 34, as in the embodiments shown in FIGS. 1 through 22, includes an approximately C-shaped body with limbs 11 which engage behind limbs 5 on the connection 2 and has a top side 19 parallel to the plane of the container opening 3, two side surfaces 17 disposed in the slide direction (arrow A) of the container 1 and two side surfaces 18 perpendicular thereto.

Figure 28:
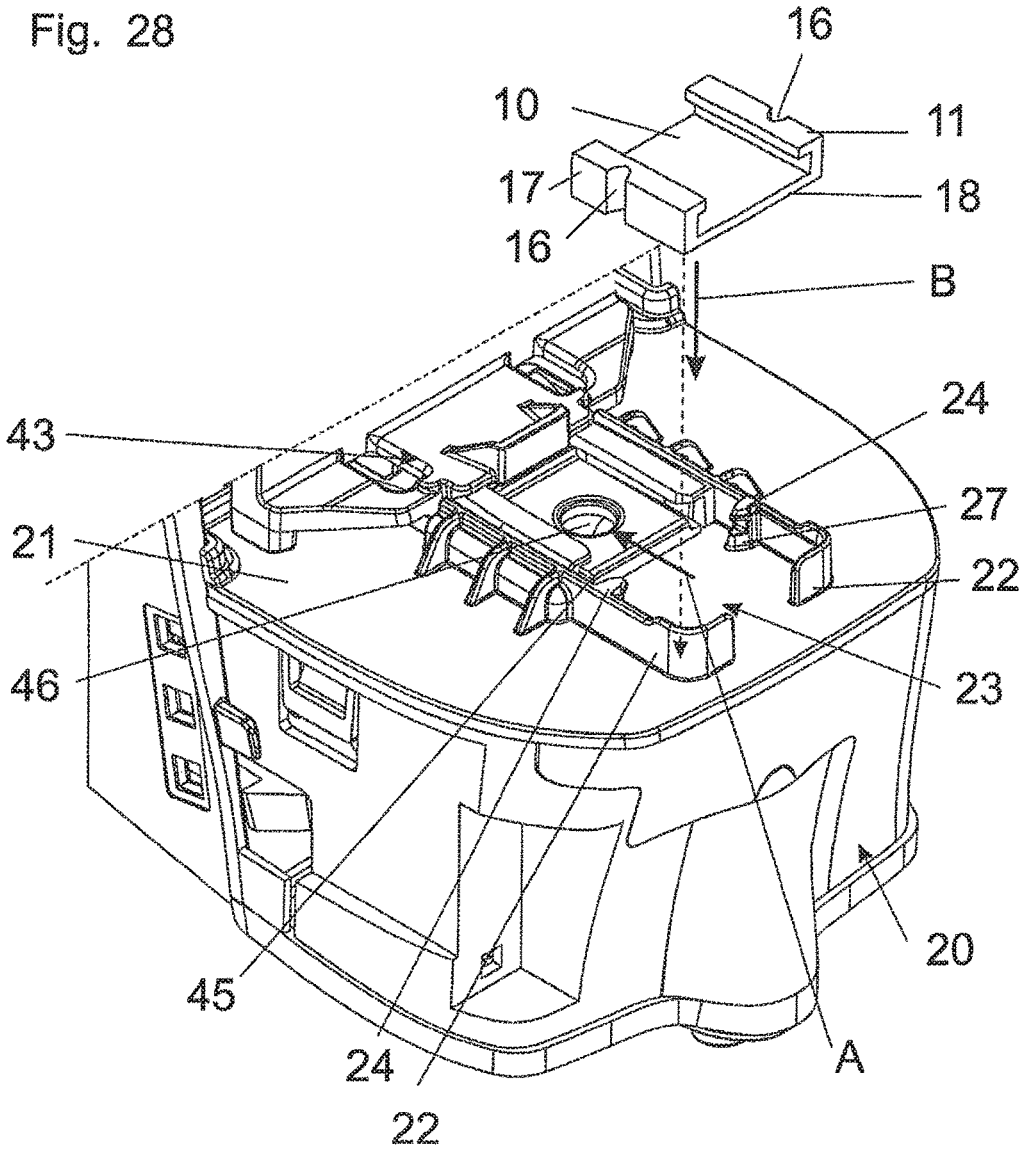
FIG. 28 is a perspective view of a second embodiment of a lower portion of the dispenser of FIG. 25.
Figure 29:
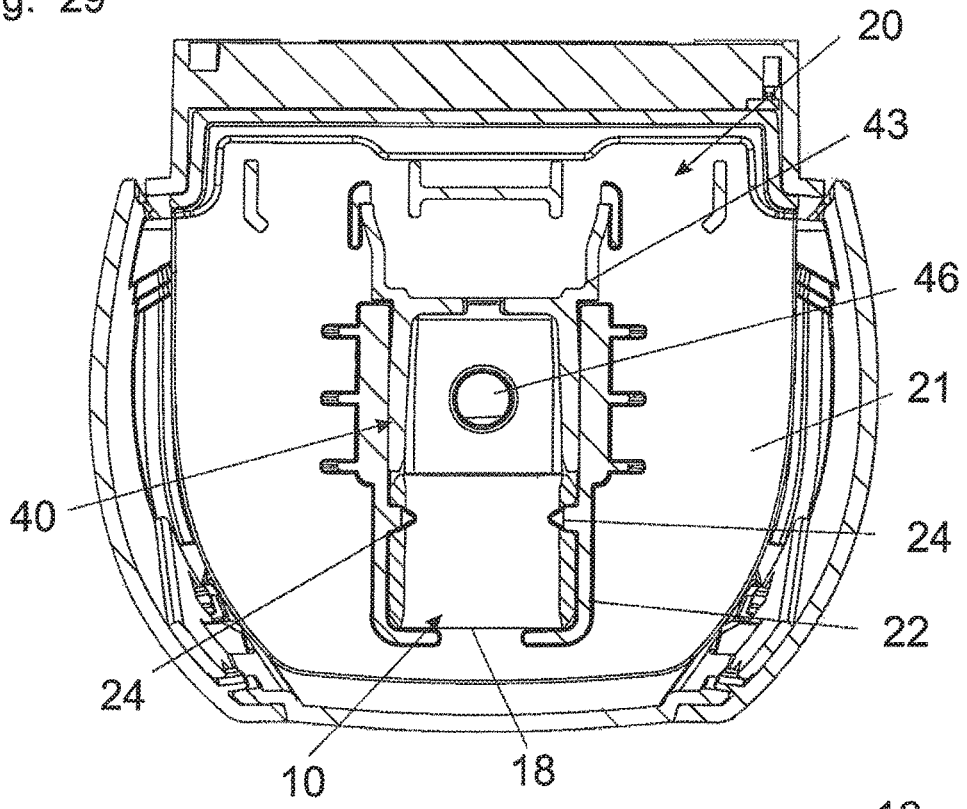
FIG. 29 is a plan view of the embodiment of FIG. 28 with a closure disposed in the deposit device, without a container.
Figure 30:
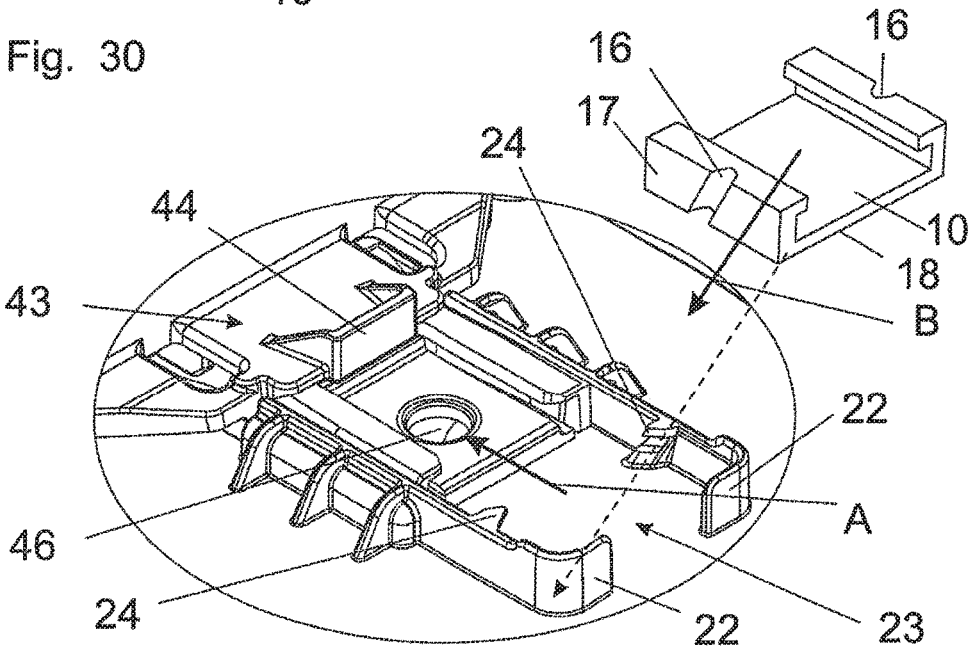
FIG. 30 is an exploded perspective view showing a part of a third embodiment of a lower portion of the dispenser as shown in FIG. 25.

FIGS. 23 through 30 show closures 10 which in at least one of the two side surfaces 17, have a recess 16 serving as coding in the form of a groove. In FIGS. 23 through 29 the groove 16 extends perpendicularly to the plane of the container opening 3 while in FIG. 30 it extends inclined forwardly. As can be seen from FIG. 24 the depth of the groove preferably corresponds to the wall thickness so that the limb 5 of the connection 2 is exposed or is not cut out. It is possible to see corresponding projections 24 in the form of noses or limbs on the dispenser immediately in front of the container mounting 40 as counterpart elements in relation to the recess 16. As can be seen from FIG. 25 the region of the cover 21 of the lower portion of the dispenser 20 is provided with a depression into which two projections 24 project. A container 1 as shown in FIG. 23 can now be introduced into the position in front of the container mounting 40 either horizontally from the side (FIG. 27), vertically from above (FIGS. 28 and 29) or inclined from above (FIG. 30). That signifies an at least approximately or precisely L-shaped travel path shown by two arrows B and A.

Figure 27:
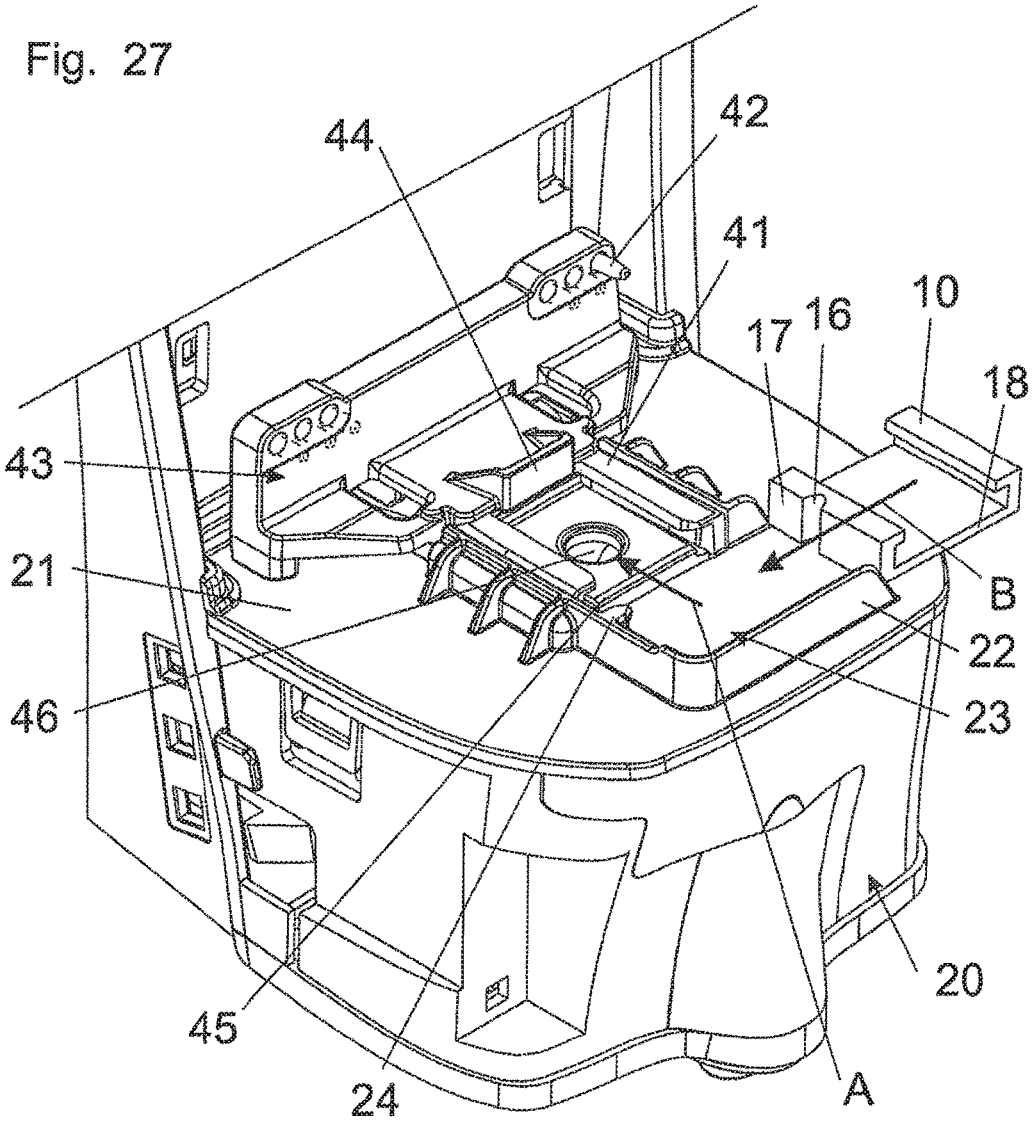
FIG. 27 is a perspective view of a first embodiment of a lower portion of the dispenser of FIG. 25.

In FIG. 27 the L-shaped path is parallel to the plane of the container opening 3 and to the plane of the opening 46 of the container mounting 40 and the closure 10 shown in FIG. 27. The container, which is not shown for the sake of clarity, moves over the first path portion corresponding to the arrow B into the chamber forming the deposit device 23 in front of the container mounting 40, in which case the projection 24 passes into the recess 16 when the two coding elements are identical. The deposit device 23 is deeper than the container mounting 40 by the thickness of the top side of the closure 10 so that the container can be further displaced in the direction of the arrow A, wherein the closure 10 remains disposed in the deposit device 23 and the medium contained in the container 1 can flow away through the openings 3 and 46 into the lower portion of the dispenser 20.

The deposit device 23 is defined by limbs 22 so that it receives the closure 10 in a form-locking relationship. As a result the container 1 is moved on to the closure 10 again upon removal in opposite relationship to the slide direction (arrow A) and is then removed in a condition of again being closed in opposite relationship to the arrow B from the dispenser. The container 1 can therefore also be exchanged while still partly filled without a partial quantity of its contents being lost.

Referring to FIG. 28 the closed containers are lowered vertically from above (arrow B) and the closure 10 is again in the deposit device 23, as shown in FIG. 29, and the container can then be inserted into the container mounting 40 (arrow A).

FIG. 30 shows the inclined configuration of the coding elements 16 and 24 and thus also the inclined direction (arrow B) of insertion into the deposit device 23. The second part of the travel path is again indicated by the arrow A into the container mounting 40.

FIGS. 27, 28 and 30 each show a perspective view illustrating the lower portion of a dispenser 20 with the cover plate 21 on which the container mounting 40 and an insert portion 43 corresponding to FIGS. 20 through 22 is provided. The only difference is the transverse limb 44 which is continuous over the width so that the container to be used in this case is without projections. Likewise, the abutment 47 is missing, in comparison with the configuration shown in FIGS. 20 through 22.

Figure 31:
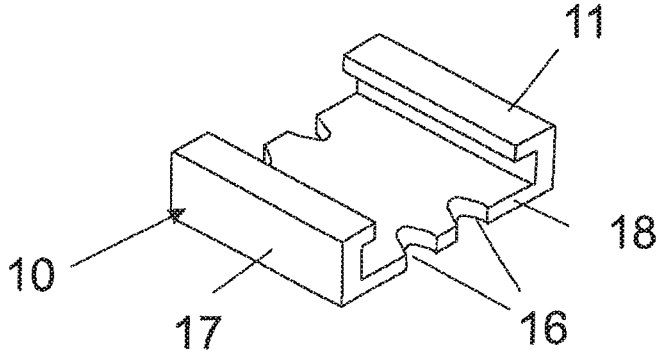
FIGS. 31 and 32 respectively show a perspective view of a closure and a plan view of a third embodiment of a lower portion of the dispenser of FIG. 25 with the closure disposed in the deposit device, without a container.
Figure 32:
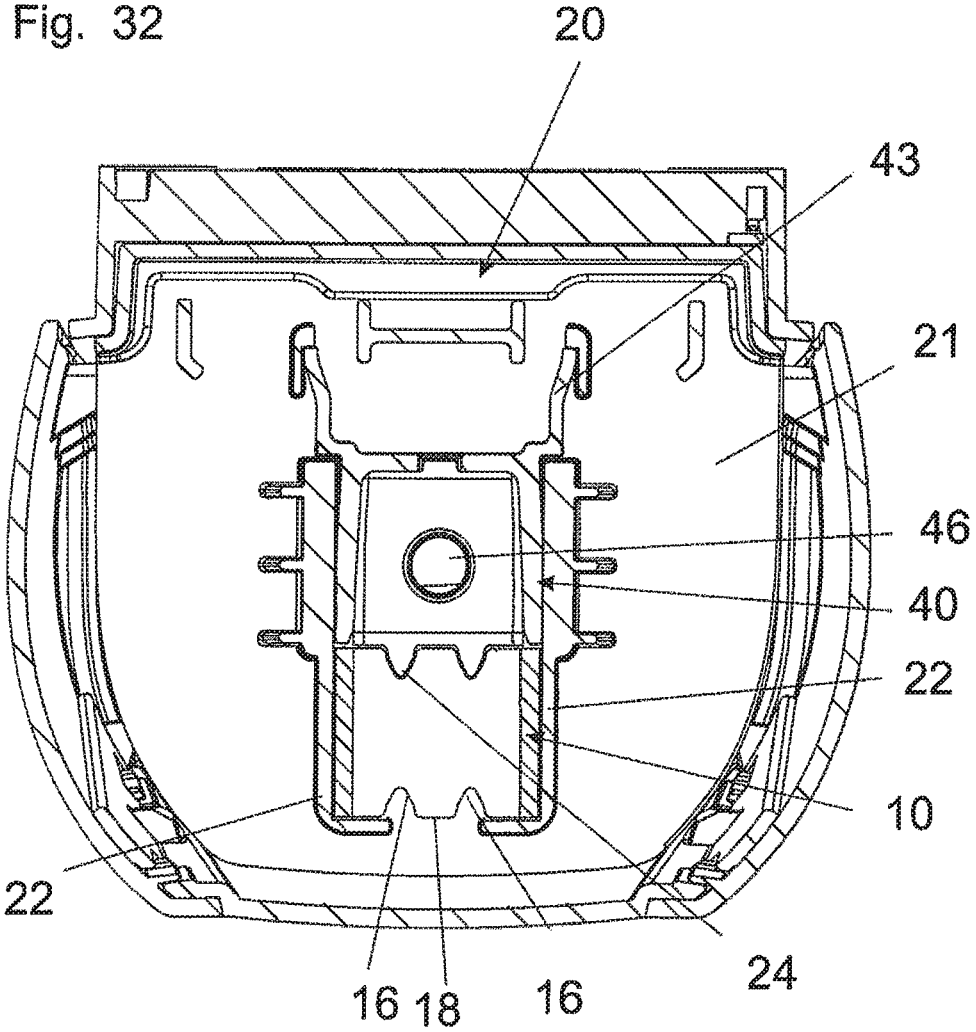

FIGS. 31 and 32 show a closure 10 on which recesses 16 are provided in the narrow side surfaces 18, wherein recesses are optionally also possible in the side surfaces as shown in FIG. 23.

The closure 10 shown in FIGS. 31 and 32 can only be introduced from above into the deposit device 23 so that insertion from the side, as shown in FIG. 27, is not possible. The other two options shown in FIGS. 28 and 30 can also be implemented with the closure 10 of FIG. 31. The closed container is inserted between the defining limbs 22 which project up from the cover plate 21, into the deposit device 23 adjoining the container mounting 40, the projections 24 passing into the recesses 16 (FIG. 32). The container is now further pushed into the container mounting 40, with the closure 10 remaining in the deposit device 23. If the container 1 is to be replaced when empty or when still partially filled it is moved back again into the deposit device 23, in which case the closure 10 which is locked in that direction by the defining limb 22 is again pushed on to the connection 2 and sealingly closes the container. Subsequently the closed container is removed.

In this embodiment a number of coding options are also afforded by a variation in the projections 24, in the region of the deposit device 23 for the closure 10. The projections 24 project from the edge of the container mounting 40 and engage into the recess 16 at the side surface 18 of the closure 10. The closure 10 again remains in the deposit device 23 when the container 1 is pushed into the container mounting 40.

Figure 33:
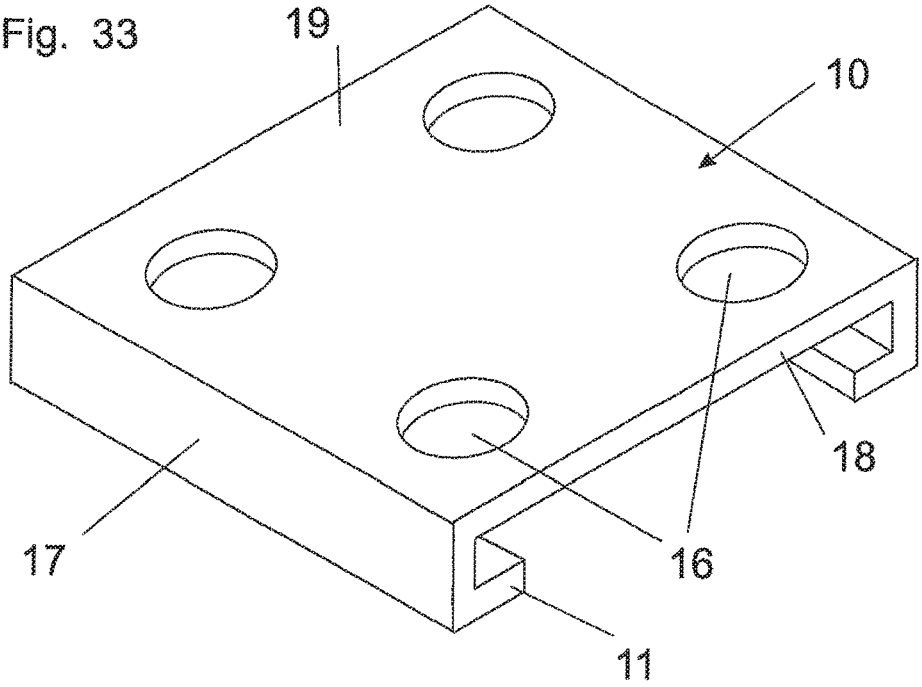
FIGS. 33 and 34 show a perspective view of a closure and a plan view of a fourth embodiment of a lower portion of the dispenser of FIG. 25 with the closure disposed in the deposit device, without a container.
Figure 34:
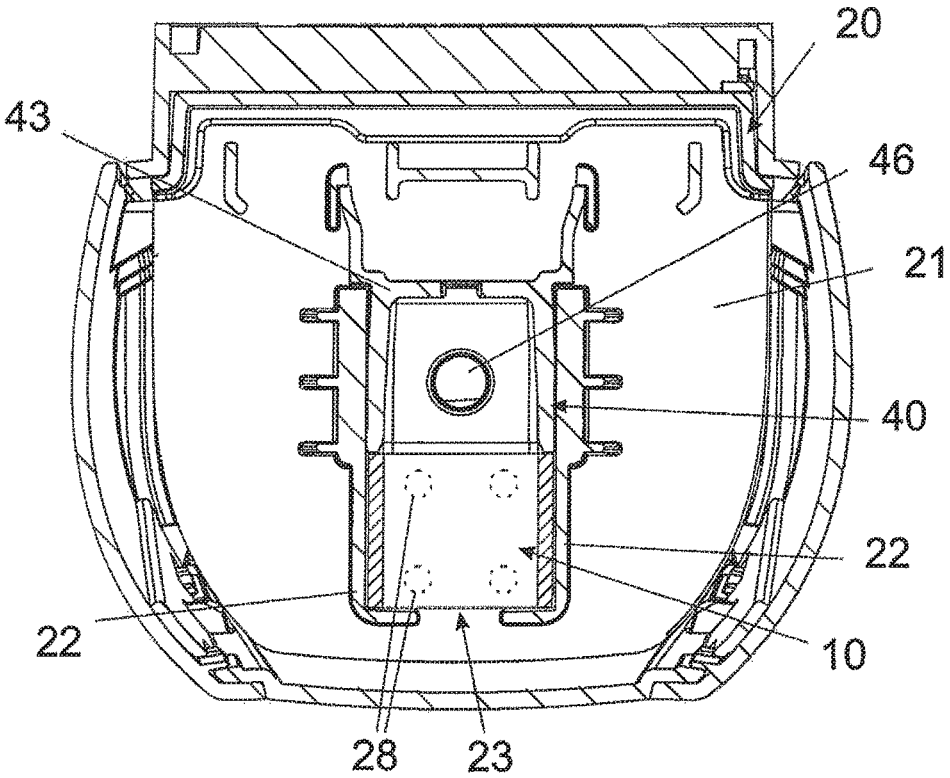
Figure 35:
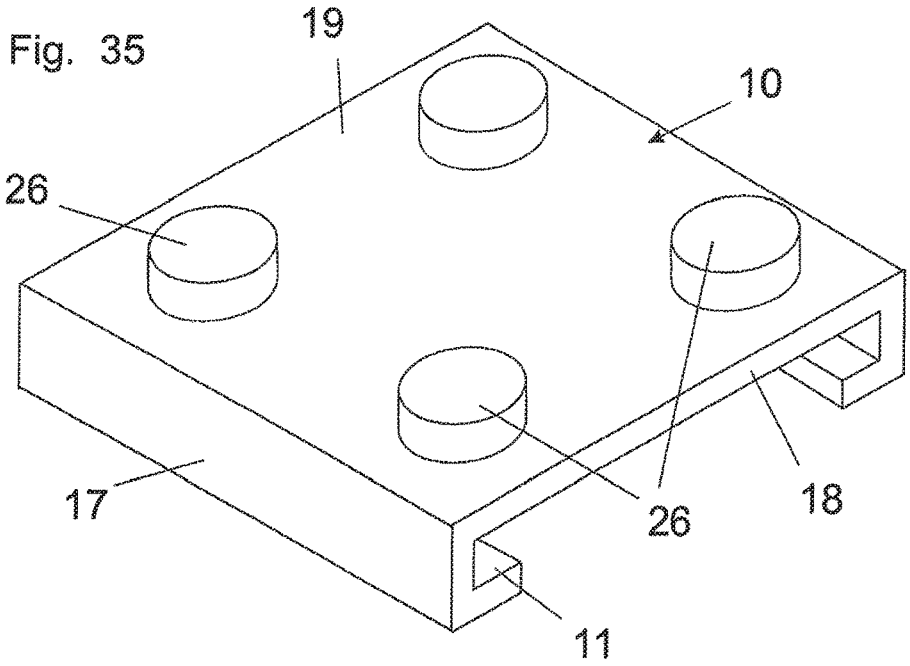
FIGS. 35 and 36 show a perspective view of a closure and a plan view of a fifth embodiment of a lower portion of the dispenser of FIG. 25 with the closure disposed in the deposit device, without a container.

FIGS. 33 through 36 show coding elements at the top side 19 of the closure 10, in which respect as shown in FIG. 33 the recesses 16 are in the form of cylindrical depressions, possibly also holes, while in FIG. 35 they are in the form of cylindrical projections 26. The corresponding counterpart portions are provided in the bottom surface of the deposit device 23, that is to say as shown in FIG. 34 the projections 28 shown in broken lines project there in the form of cylindrical knobs or the like and in FIG. 36 depressions 25 are in the form for example of cylindrical blind holes in the cover 21.

Projections 24, 27, 28 (limbs, noses, knobs and so forth) projecting into the deposit device 23 allow holes in the cover plate 21, which are covered over by the projections 24, 27, 28, to provide tamper protection. If those projections of the deposit device 23 are removed in order to be able to insert for example containers 1 as shown in FIG. 1 without a recess 16 in the closure 10 then those holes are exposed.

Preferably provided in the dispenser 20 beneath the cover 21 is a chamber (in particular an intermediate container, a pump chamber or the like), into which the liquid flows out of the container 1 fitted into the container mounting 40 (FIG. 19) and which loses sealing integrity due to the removal of the projection 24.

In FIGS. 29 and 32 the closure 10 is sectioned in each case parallel to the plane of the container opening 3 whereby engagement of the projections 24 into the recess 16 is more clearly apparent. The section plane extends directly beneath the limbs 11 of the closure 10.

Figure 36:
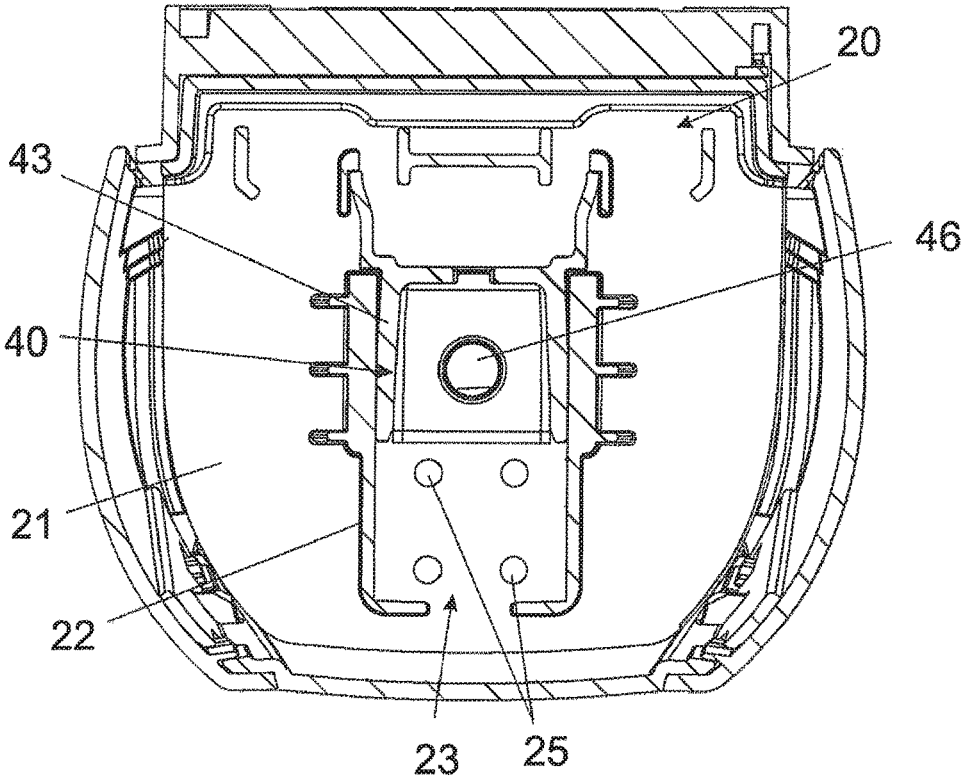

The section planes in FIGS. 34 and 36 are in the same position, with the closure 10 not being shown in FIG. 36.

In FIGS. 28 and 30 the projections 24 projecting into the deposit device 23 are subdivided horizontally whereby a second projection 27 remains at the bottom of the deposit device 23, and that projection, as mentioned above, exposes a hole in the cover when it is removed.

The invention claimed is:

1. A dispensing system for a flowable product, the dispensing system comprising:

at least one dispenser having a container mounting and at least one container for receiving a flowable product;

said container having:

a connection disposed at a side of the container, said connection having an opening formed therein;

at least one guide element disposed on said connection; and a closure slidably mounted relative to said container at or in said at least one guide element, said closure being removable by displacement of said container in a slide direction;

said side of said container having said connection including at least one of at least one projection projecting forwardly in said slide direction or at least one forwardly open socket;

said at least one container being held upside down in said container mounting after removal of said closure;

similar guide elements being provided on said closure and on said container mounting and supplementing each other or prolonging each other upon insertion of said container being closed;

said container mounting having a recess or a projection respectively corresponding to said projection or to said socket at said side of said container provided with said connection; and a cover plate disposed at a lower portion of said dispenser, and an exchangeable insert portion being held in said cover plate, said guide elements and at least one of said recess or said projection of said container mounting being provided on said exchangeable insert portion.

2. The dispensing system according to claim 1, which further comprises a substantially L-shaped path for insertion of said container into the dispenser, said substantially L-shaped path having a first path portion extending perpendicularly to said slide direction.

3. The dispensing system according to claim 2, wherein said first path portion extends horizontally.

4. The dispensing system according to claim 2, wherein said first path portion extends vertically.

5. The dispensing system according to claim 2, which further comprises a depression with said container mounting in said cover plate being provided at an end of said first path portion as a deposit device for said closure.

6. The dispensing system according to claim 1, wherein at least one of said at least one projection or said at least one socket is disposed on said connection.

7. The dispensing system according to claim 6, wherein said connection has two sides and two limbs each projecting from a respective one of said sides and forming said guide elements for said closure, one of said limbs being shorter than said closure to form said socket.

8. The dispensing system according to claim 1, wherein said socket has a depth being equal to an internal width of said opening in said slide direction.

9. The dispensing system according to claim 1, wherein said socket is covered over by said closure.

10. The dispensing system according to claim 6, wherein said connection has two sides and two limbs each projecting from a respective one of said sides and forming said guide elements for said closure, one of said limbs being longer than said closure to form said forwardly protruding projection.

11. The dispensing system according to claim 1, wherein said connection has at least one of first and second sockets or projections turned through 180°.

12. The dispensing system according to claim 11, wherein said closure has a projection engaging into said second socket.

13. The dispensing system according to claim 1, which further comprises a U-shaped reinforcing plate carrying said connection and embracing the container at oppositely disposed edges, said U-shaped reinforcing plate having upstanding limbs, and at least one of said upstanding limbs having at least one of at least one projection or at least one socket.

14. The dispensing system according to claim 13, wherein said limbs extend perpendicularly to said slide direction and said at least one socket is a hole.

15. The dispensing system according to claim 1, which further comprises a compressible sealing ring surrounding said opening, said compressible sealing ring projecting at an end of said connection.

16. A dispensing system for a flowable product, the dispensing system comprising:

at least one dispenser having a container mounting and at least one container for receiving a flowable product;

said container having:

a connection disposed at a side of said container, said connection having an opening formed therein;

at least one guide element disposed on said connection; and a closure being slidable relative to said container at or in said at least one guide element, said closure being removable by displacement of said container in a slide direction;

said side of said container having said connection including at least one forwardly open socket;

a tab being attached by an intended breaking location and disposed to be broken off to form said socket;

said at least one container being held upside down in said container mounting after removal of said closure;

similar guide elements being provided on said closure and on said container mounting and supplementing each other or prolonging each other upon insertion of said container being closed; and said container mounting having a projection corresponding to said socket at said side of said container provided with said connection.

* * * * *